United States Patent [19]

Read

[11] Patent Number: 4,707,003

[45] Date of Patent: Nov. 17, 1987

[54] RELEASABLE LOCK MECHANISM

[76] Inventor: Donald L. Read, P.O. Box 25007, Denver, Colo. 80225

[21] Appl. No.: 904,066

[22] Filed: Sep. 5, 1986

[51] Int. Cl.[4] ..... E05C 19/02

[52] U.S. Cl. ..... 292/45; 292/336.3; 292/49

[58] Field of Search ..... 292/44, 45, 54, 230, 292/238, 24, 25, 31, 56, 27, 49

[56] References Cited

U.S. PATENT DOCUMENTS

| | | | |
|---|---|---|---|
| 2,110,940 | 3/1938 | Pavelka | 292/54 |
| 2,510,178 | 6/1950 | James | 292/230 X |
| 3,043,617 | 7/1962 | Shelton | 292/230 X |
| 3,384,406 | 5/1968 | Welch et al. | 292/54 X |

*Primary Examiner*—Richard E. Moore

*Attorney, Agent, or Firm*—Thomas Zack; E. Philip Koltos

[57] ABSTRACT

This invention relates to a mechanism useful to retain a bi-positionable part in one of its positions so as to prevent inadvertent return of the part to its other position. The unit includes gripping jaws having an open position or status to receive the part in its to-be-retained position, plus weight-influenced members and elements to close the jaws to secure the part. The release or unlock mode of the unit is capable of being remotely effectuated by movement of the part in an over-run phase so as to actuate the jaws to release position for freeing the part. The unit is so constructed as to be compact, self-contained and easy to operate and maintain.

10 Claims, 19 Drawing Figures

RELEASABLE LOCK MECHANISM

BACKGROUND AND SUMMARY OF THE INVENTION

There are many instances in which a part is moved to a selected position but which position is not easily maintained because of forces tending to cause the part to move out of that position. One such example is the gate in a flow-control system where the gate is, for example, hydraulically moved to an open position from which it often tends to drift back to a closed or partly closed position. Various forms of locks and equivalent retainers have been provided for eliminating this problem, but none has been completely acceptable when considering the factors of original cost, maintenance, reliability and integrity. The locking device most commonly used today in this case is called the semi-automatic gate hanger. It is a purely mechanical device and, as is the case with other mechanical locking devices, it must be reset after each operation by means of a secondary operation: that of releasing a lever and spring and then resetting the same.

According to the present invention, in a preferred form, a novel releasable lock mechanism has been incorporated in a compact unit made up of relatively few working parts for the closing and opening of a pair of complementary jaws capable of gripping and releasing a movable part, such as the operator, for example, connected to a gate control of the character just mentioned. It is a feature of the invention to employ biased elements operative to function in its lock and release modes by selected travel of the part or operator to be controlled.

Further features and advantages will become apparent as a preferred embodiment of the invention is disclosed in detail herein in conjunction with the accompanying sheets of drawings.

DETAILED DESCRIPTION OF A PREFERRED EMBODIMENT OF THE INVENTION

Figure 1:
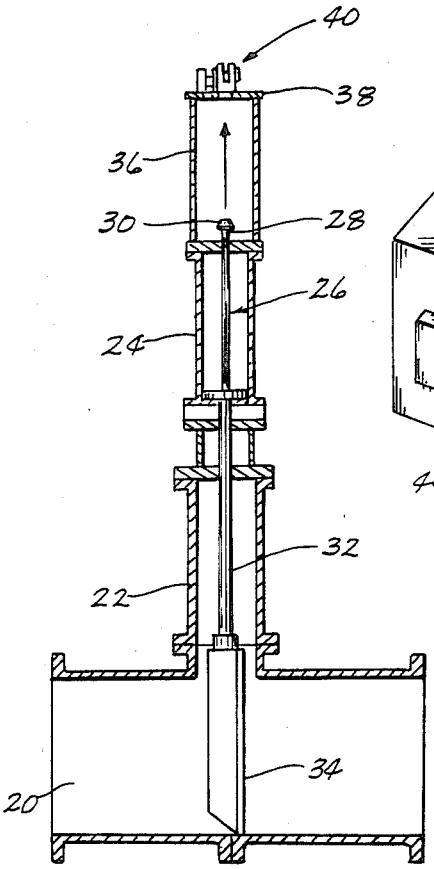
FIG. 1 is a reduced-scale, largely schematic view, partly in section of a structure in which the invention finds utility.
Figure 2:
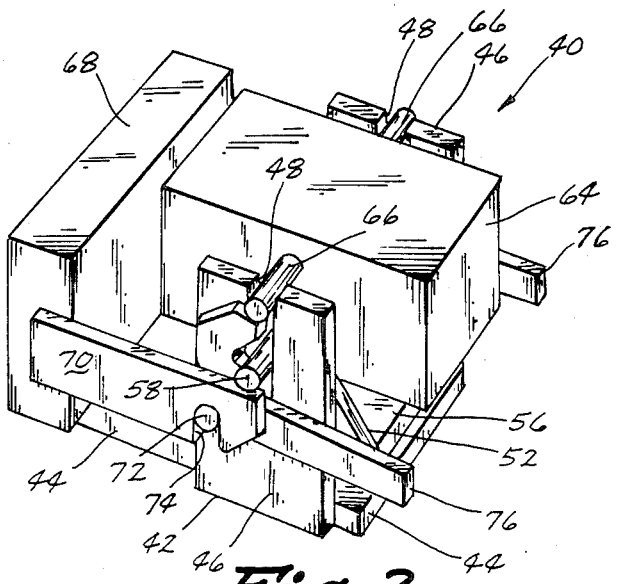
FIG. 2 is an enlarged perspective of the unit apart from any environmental background.

In the example chosen for illustration (FIG. 1), a horizontal liquid flow pipe (20) is shown as having an upright tubular standard (22) which is coaxial with a hydraulic actuator (24) whose piston rod (26) projects upwardly as a coaxial stem (28) having a terminal head (30) in the form of a truncated cone. The piston is further connected coaxially to a downwardly extending rod (32) which in turn is attached to a leaf gate (34). The stem and head are enclosed in an upper coaxial cylinder (36) which is closed at its upper end to provide a fixed support (38).

Figure 3:
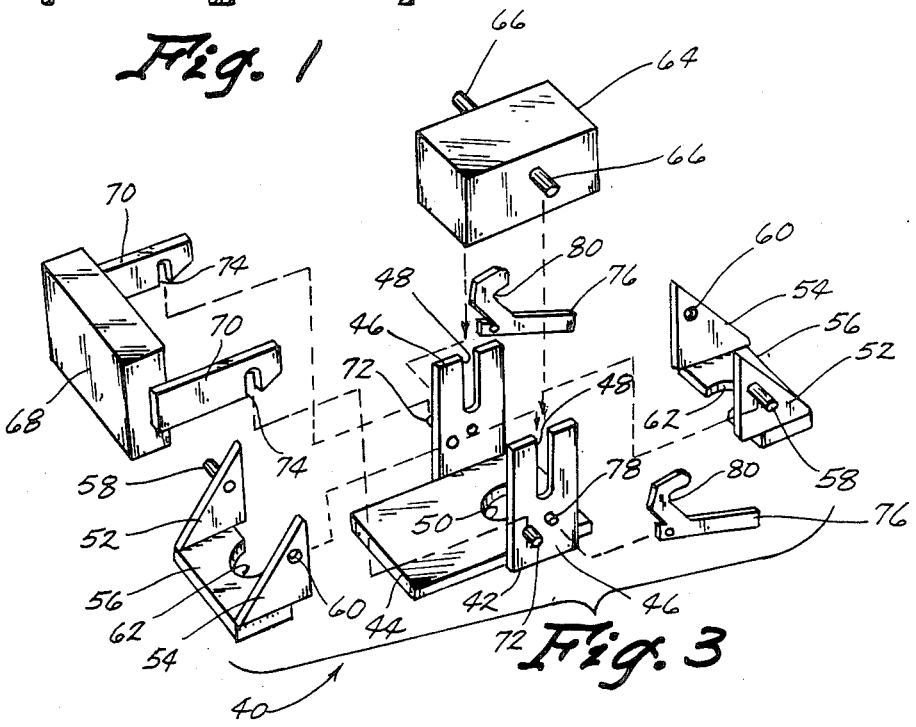
FIG. 3 is a smaller scale exploded perspective illustrating the unit parts and their relationship to each other.
Figure 4:
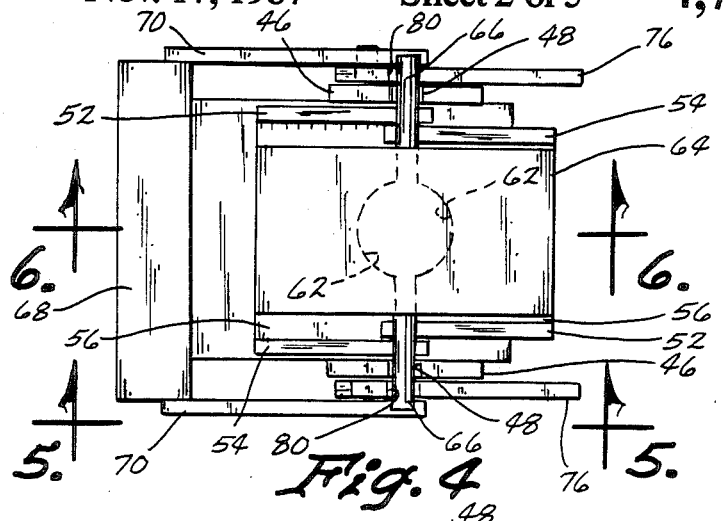
FIG. 4 is a plan view of the assembled unit.
Figure 8:
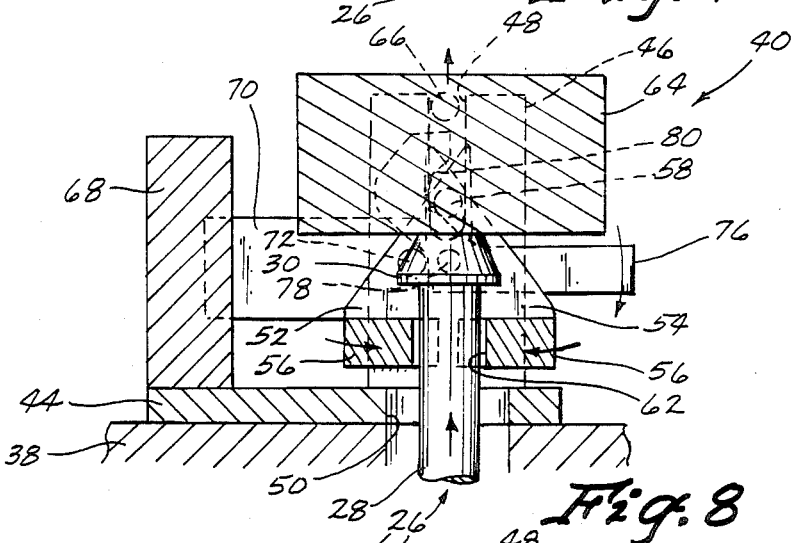
FIG. 8 is a sectional view, comparable to FIG. 6, but showing the parts as they are in FIG. 7.

The preferred embodiment depicting the inventive mechanism is denoted in its entirety by the numeral (40) and is fixedly mounted on the upper end (38) of the cylinder (36). The components of this unit are best seen in disassembled form in FIG. 3 as comprising a support (42) including a base (44) and a pair of upright, spaced apart parallel walls (46) rigid with the base. Each wall has an upright slot (48) and the base has a through opening (50), for purposes to presently appear. The base is suitable fixed to the top of the cylinder (36) by any appropriate means (not shown). A further part of the unit is a pair of gripping members (52), each of which includes a pair of upwardly extending arms (54) from which a jaw (56) depends. One arm of each member has a horizontal pivot pin (58) and the opposite arm has a coaxial opening (60). The two members are assembled with the pins and holes respectively interengaging, thus providing horizontal pivot means on which the members are mounted, scissor fashion, resulting in the arms extending upwardly in divergent fashion above the pivot means (FIGS. 5 and 6, for example) and the jaws depending below the pivot means. The jaws are weighted so as to be biased in closed position, from which position they may be forcibly moved to open position. Compare FIGS. 6 and 8. Each jaw is formed with a semi-circular or like notch (62) for gripping the stem below its head (30), as will be explained later. The assembled jaws are mounted in the wall slots (48) via the pivot pins (58), which extend respectively outwardly from the walls.

Figure 5:
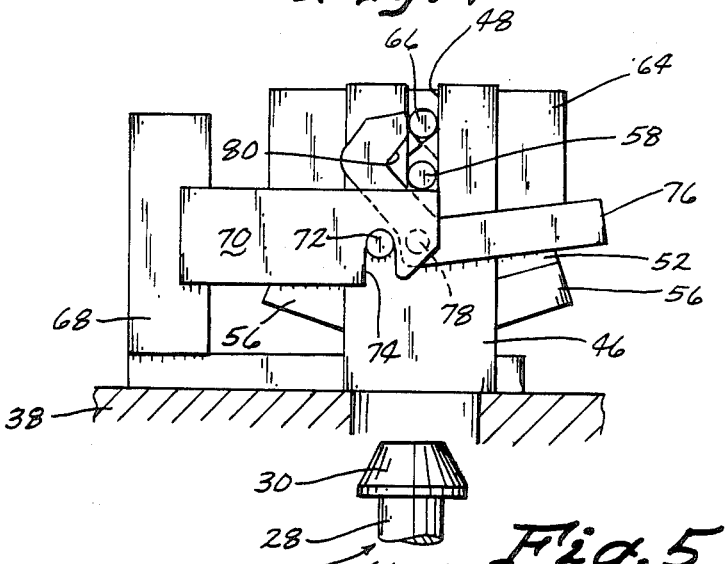
FIG. 5 is an elevation view as seen along the line 5—5 of FIG. 4, showing the parts in a static position in which the jaws are open.
Figure 6:
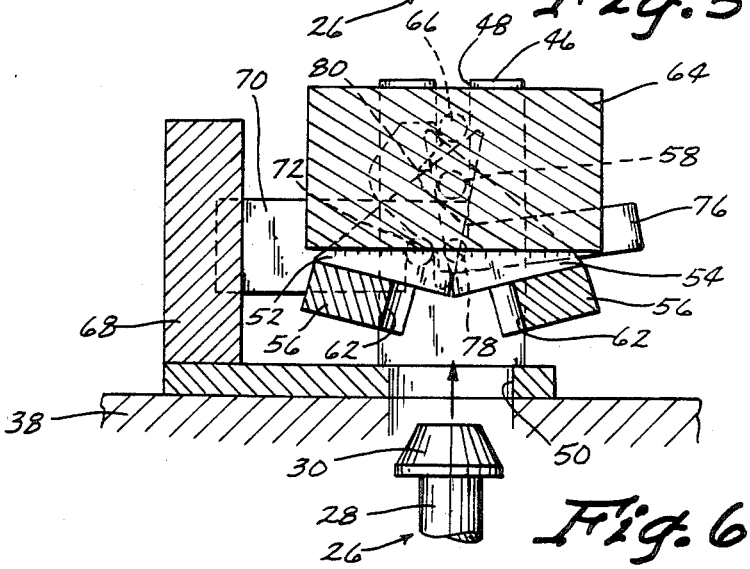
FIG. 6 is a sectional view along the line 6—6 of FIG. 4 with the parts disposed as in FIG. 5.

Another component of the unit is a release weight (64), preferably of an appropriate heavy material, from opposite sides of which project guide pins or portions (66). These pins ride in or are guided by the wall slots and disposed above the pivot means (58). As best seen in FIG. 6, for example, the pins (66) are received by the upwardly divergent jaw arms and tend to force the arms apart, resulting in tending to swing the weighted jaws apart toward their open position. In order to prevent the weight from simply pushing the jaw pivot means (58) to the bottoms of the slots, a reset weight (68) is provided. This has a pair of arms (70) straddling the walls and pivoted to the walls by coaxial pivot pins (72), the terminal end of each arm being slotted at (74) to removably receive the pins; that is, so that the weight may be removed in an upwardly direction. In its normal position, the weight is stopped against counter-clockwise movement out of its FIG. 5 position by engagement with the base (44). In short, since the pivot means (58) engages the weight arms (70) from above and to the right of the pivot (72), the weight resists downward movement of the jaw pivot means until pre-selected forces are applied, as will be clarified subsequently.

Figure 7:
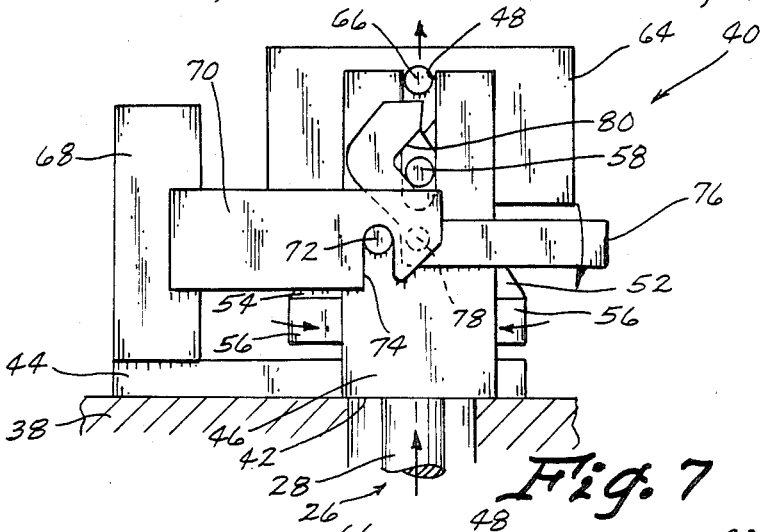
FIG. 7 is an elevational view, like FIG. 5, but showing the status of the unit with the jaws closing on an upwardly moving part.
Figure 11:
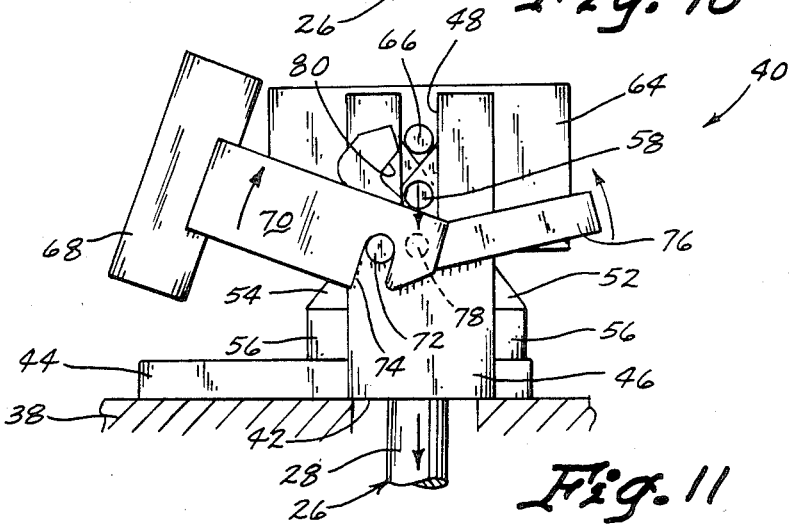
FIG. 11 is an elevational view showing the jaws closed and abutting the base on the down stroke of the movable part.

The pins (66) of the weight (64) are relatively freely slidable up and down in the wall slots but may be prevented from moving downwardly beyond a predetermined limit by latch means, here comprising a pair of latch elements, each of which is L-shaped and pivoted on a horizontal axis to the respective wall by a pin (78). Because of the configuration of each latch, it is weight-biased to swing in a clockwise direction as seen in the drawings. One position of the latch is shown in FIG. 5, wherein the nose of the latch is to the left or clear of the associated weight pin (66) which means that the weight pins are free to slide within their limits in their respective slots. Another position of the latches appears in FIGS. 7, 8 and 9, wherein the nose of the latch is disposed below and thus in the path of downward movement of the associated weight pin (6), thus intercepting or blocking the weight and preventing it from applying force to the jaw pivot means (58). The position of the latches may be achieved manually at the start. It is preferred, however, that subsequent operation of the unit be controlled from a remove point, as via the hoist control, and also that the operation be made positive. As seen in FIG. 11, descent of the jaw pivot means (58) as a result of force in excess of that applied by the weight (68) will cause the pivot means (58) to "kick" the latch in a counter-clockwise direction because of a cam slope (80) on the short arm of the latch.

The unit is assembled to the top of the cylinder (38), either by affixing the base directly to the open top of the cylinder or by attaching it to a cylinder top plate, for example. In either case, the base becomes rigid with the cylinder and the whole forms a fixed support for the movable parts of the unit. The hole (50) in the base is of course coaxial with the steam so that the stem and head may move upwardly and downwardly into and out of the unit.

Figure 9:
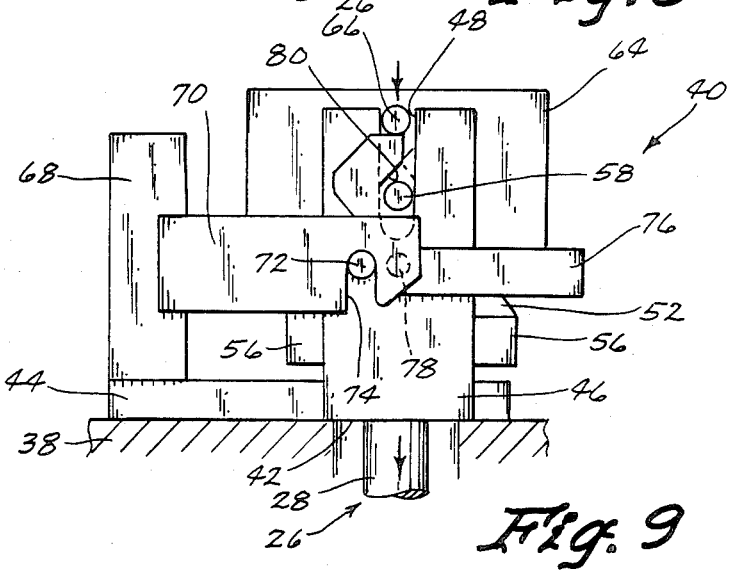
FIG. 9 is an elevational view showing the parts in the positions they occupy when the latch is engaged with the release weight.
Figure 10:
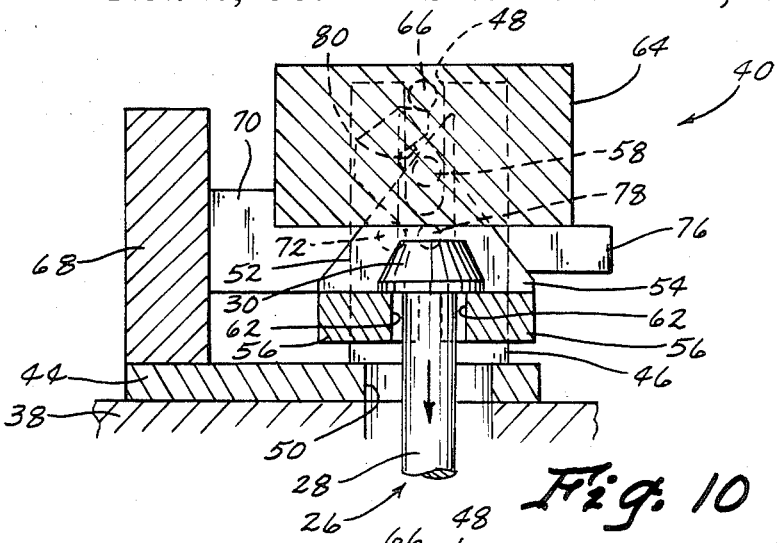
FIG. 10 is a sectional view of the unit in the status depicted in FIG. 9.
Figure 12:
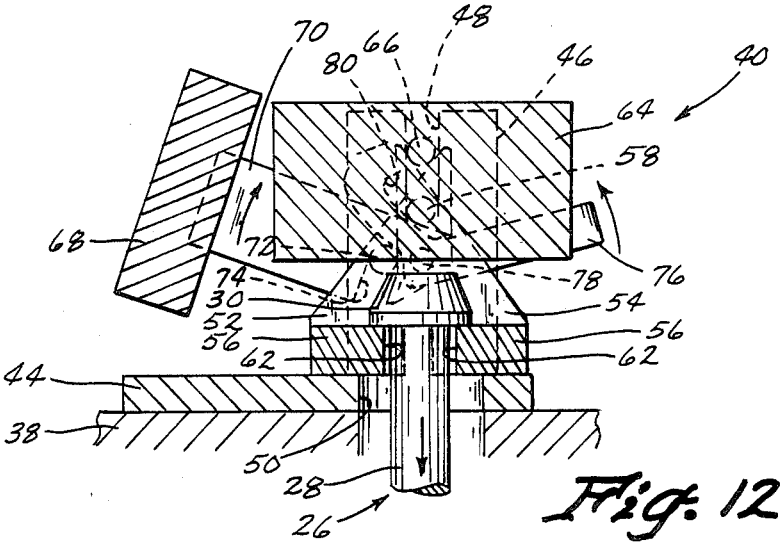
FIG. 12 is a sectional view of the unit in the stage of FIG. 11.
Figure 13:
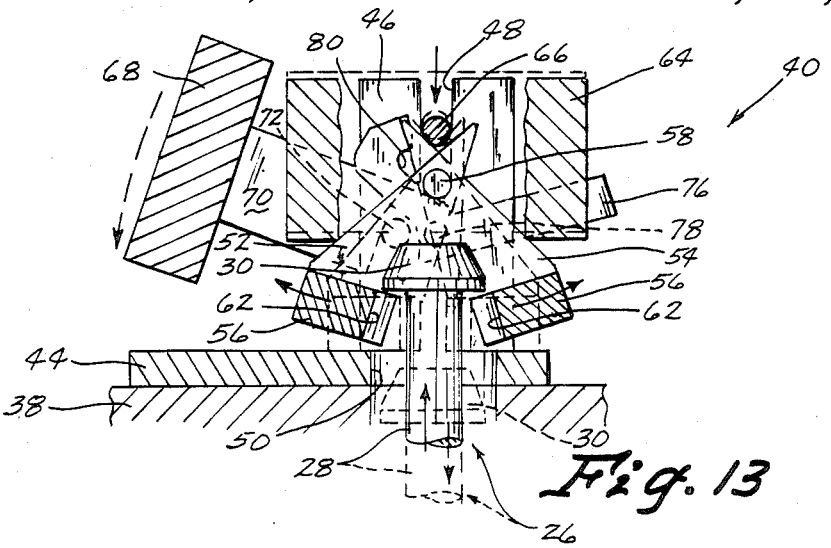
FIG. 13 is a sectional view illustrating opening of the jaws to release the previously-gripped movable part.

FIGS. 5 and 6 represent a starting position in which the release weight (64) has caused opening of the jaws preparatory to receiving the upwardly moving stem head (30). The jaw pivot means is in what may be termed an upper position, resting on the short lever arm of the reset weight (68). The jaws are clear of the top of the unit base. The head (30) rises through the open jaws and engages and moves the release weight (64) off the jaws and the jaws close under their own weight. At the same time, the latches (76), now free of the release weight pins (66), swing clockwise (FIG. 7) into the path of downward movement of the release weight, the latches being stopped when the cams (80) strike the jaw pivots (58). The stem, now engaged by and locked to the jaws descends a limited amount, followed by the release weight until the release weight pins are stopped by the latch (76) (FIG. 9). Further descent of the steam and jaws continues until the jaws are stopped by the upper surface of the unit base (FIGS. 11 and 12). This is the final lowered position of the stem until deliberately released. Note that as the jaws and stem descend to the base-stopped position, the jaw pivot (58) is moved downwardly against the bias of the reset weight, which is overcome by the weight of the stem and its gate. As the jaws move thus downwardly, the jaw pivots engage the latch cams (80) and kick the latch counterclockwise and thus out of the path of the pins (66).

When it is desired to lower the gate, the hydraulic hoist is operated to raise the stem slightly, enough to take the load of the head off the jaws, and the release weight opens the jaws to free the head. At the same time, the reset weight returns to normal position (FIG. 5), raising the jaws to starting position, again clear of the unit base.

The principles of the invention are applicable to other instances, as suggested in FIGS. 14 through 19, which is assumed to be clear enough without further description.

It should be understood that many modifications and alterations may be made in the preferred embodiments of the invention disclosed herein, all without departure from the spirit and scope of the invention.

It should also be understood that the use of weights and counterweights as a means of providing the biased operation of the various parts of the invention may be replaced by the use of springs as preferred in each specific case all without departure from the spirit and scope of the invention.

Figure 14:
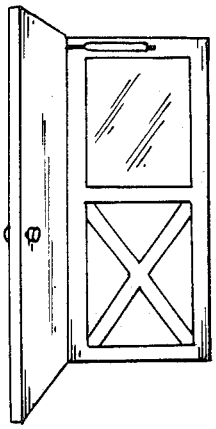
FIGS. 14 through 19 are simplified examples of other arrangements utilizing the principles of the invention.
Figure 15:
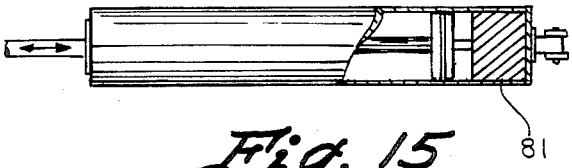
Figure 16:
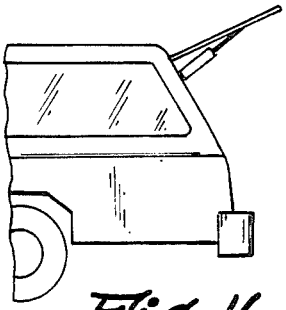
Figure 17:
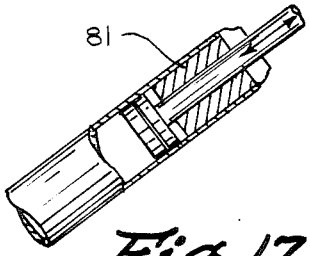

FIG. 14 shows a household storm door operated by a closing cylinder and FIG. 15 is a detail of that cylinder. FIG. 16 shows an automobile hatch-back operated by an opening cylinder and FIG. 17 is a detail of that cylinder. Both cases are an alternate embodiment of the invention (81) as it is enclosed within a spring-loaded or gas-charged cylinder. In this case, the invention would almost assuredly be spring-operated rather than weight-operated because of space limitations and because the invention is not mounted vertically.

Figure 18:
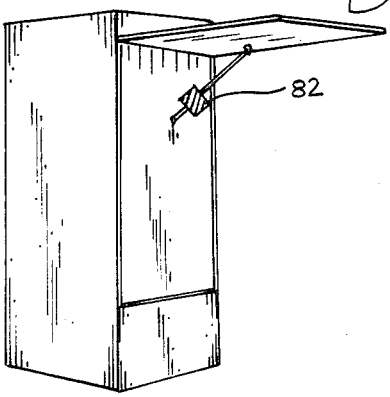
Figure 19:
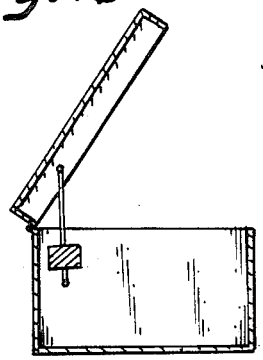

FIG. 18 and FIG. 19 each demonstrate another alternate embodiment of the invention (82) as it is mounted on a sliding rod in order to lock a chest door in the open position. In this case, the invention could easily be weight-operated with the weights and jaws modified to accommodate the angle at which the invention is when the locking action occurs.

I claim:

1. Releasable lock mechanism, comprising: a support including an upright wall, a horizontal pivot means projecting normal to the wall, a pair of gripping members disposed alongside the wall and pivoted together, scissor fashion, on the pivot means and providing a pair of upwardly divergent arms above the pivot means and a pair of complementary, depending jaws below the pivot means, the jaws being biased toward each other to a closed position but forcibly movable apart to an open position, means mounting the pivot means on the wall for limited upward and downward movement of the pivot means and jaws, first weight means carried by the wall and engaging the pivot means for resisting downward movement of the pivot means and jaws, second weight means carried by the wall and including a portion entering between the divergent arms from above and acting to spread the arms and thus to forcibly open the jaws, and a latch element carried by the wall for movement between a first position engaging the second weight means and intercepting its downward force on the arms and a second position freeing the second weight for downward movement to act on the arms.

2. The mechanism of claim 1, including trip means for causing movement of the latch element to its second position upon downward movement of the pivot means in response to downward forces, additional to forces exerted by the second weight means, sufficient to overcome the resistance of the first weight means.

3. The mechanism of claim 2, in which the trip means includes the pivot means and cooperative cam means on the latch element.

4. The mechanism of claim 2, in which the wall has an upright slot therein and the pivot means is guided in the slot.

5. The mechanism of claim 4, in which the second weight means is guided in the slot.

6. The mechanism of claim 1, in which the wall has an upright slot therein, the pivot means is guided in the slot, the first weight means is pivoted on the wall means and includes an arm engageable from above by the pivot means.

7. The mechanism of claim 1, including a second, upright wall spaced from and parallel to the aforesaid wall, the gripping members being disposed between the walls, and the pivot means being guided by both walls.

8. The mechanism of claim 7, in which the latch element is pivotally attached to one wall and a second similar latch element is pivotally attached to the other wall.

9. The mechanism of claim 7, in which both weight means are carried by both walls.

10. The mechanism of claim 7, in which the support includes a horizontal base, the walls are rigid with and rise from the base, and the base has a through opening therein vertically aligned with the jaws.

* * * * *